United States Patent [19]

Nagy et al.

[11] 4,439,131

[45] Mar. 27, 1984

[54] APPARATUS FOR PRODUCING CONCRETE ELEMENTS OF HIGH DIMENSIONAL ACCURACY

[75] Inventors: Làszlò Nagy; László Papp; László Toth; Endre Jankovics; Zoltán Várnagy, all of Budapest, Hungary

[73] Assignee: Beton- és Vasbetonipari Müvek, Budapest, Hungary

[21] Appl. No.: 347,870

[22] Filed: Feb. 11, 1982

Related U.S. Application Data

[63] Continuation-in-part of Ser. No. 344,091, Jan. 29, 1982, abandoned, which is a continuation of Ser. No. 95,144, Sep. 6, 1979, abandoned, which is a continuation of Ser. No. 906,576, May 16, 1978, abandoned, which is a continuation of Ser. No. 725,795, Sep. 23, 1976, abandoned.

[30] Foreign Application Priority Data

Sep. 24, 1975 [HU] Hungary ..... BE 1241

[51] Int. Cl.[3] ..... B28B 1/08

[52] U.S. Cl. ..... 425/436 R; 249/112; 249/135; 249/142; 264/334; 425/424; 425/432; 425/438

[58] Field of Search ..... 425/432, 436 R, 436 RM, 425/62, 438, DIG. 111, 424; 249/112, 142, 135; 264/334

[56] References Cited

U.S. PATENT DOCUMENTS

| | | | |
|---|---|---|---|
| 373,572 | 11/1887 | Van Winkle | 425/438 |
| 837,760 | 12/1906 | Whisler | 249/142 |
| 1,921,699 | 8/1933 | Raym et al. | 249/142 |
| 2,153,741 | 4/1939 | Cobi | 264/334 |
| 2,193,847 | 3/1940 | Strong | 425/432 |
| 2,295,007 | 9/1942 | Plass | 249/142 |
| 3,618,170 | 11/1971 | Owens | 249/142 |
| 3,904,231 | 9/1975 | Lyons | 425/436 R |

*Primary Examiner*—James B. Lowe
*Attorney, Agent, or Firm*—Gabriel P. Katona

[57] ABSTRACT

Concrete elements and a lifting mechanism are secured against tilting at the time of form removal, and the formwork is fixed in place. In the apparatus, a forming unit, a concreting unit and a form removal unit are provided. The forming unit has a single rigid form adapted to shape the bottom and the sides of the elements or products, is open on top and is assembled for use as required. The form removal unit has means for maintaining the product and the removal unit itself in a fixed position against tilting, as well as means for maintaining the formwork in a fixed position, and means for actuating them.

3 Claims, 18 Drawing Figures

APPARATUS FOR PRODUCING CONCRETE ELEMENTS OF HIGH DIMENSIONAL ACCURACY

RELATED APPLICATIONS

This is a continuation-in-part of Ser. No. 344,091 filed on Jan. 29, 1982 which is a continuation of Ser. No. 95,144 filed on Sept. 6, 1979, which is a continuation of Ser. No. 906,576 filed on May 16, 1978 which is a continuation of Ser. No. 725,795 filed on Sept. 23, 1976, now all abandoned.

BACKGROUND OF THE INVENTION

This invention relates to an apparatus for producing prefabricated concrete and reinforced concrete elements having high dimensional accuracy. More particularly, this invention relates to an apparatus for producing tunnel elements such as the tube shaped elements of subway tunnels which require great dimensional accuracy.

Prefabricated elements used to construct concrete structures, particularly those structures having special fields of application and utilization, e.g. tunnels, must meet stringent strength and dimensional accuracy standards. In order to properly fabricate the elements, the formwork and forms must be constructed so that the elements are fabricated with dimensional accuracy. In addition, a proper insert system must be used which can be placed accurately into the forms during fabrication of the elements so that dimensional accuracy and integrity is assured. Also, the water to cement ratio used in the preparation of the concrete as well as the particle structure of additives must be correct to assure adequate strength of the finished elements. Of course, the working of the concrete into the forms, its setting and removal of the finished element must be controlled so that the finally fabricated element has dimensional accuracy and integrity as well as the required strength. In addition, it is advantageous if the form can be reused to assure that each of the finished concrete elements has the same dimensions, if such is required, thus making it possible to have serial production of substantially identical products.

Typical concrete elements of the type which this invention contemplates are tubing elements for subway tunnels. The subway tunnels are assembled from slice-shaped cylindrical elements which are required to meet stringent strength and dimensional accuracy standards. These standards are much stricter than the conventional standards used in the manufacture of concrete elements which are not intended to be used in structures of the type described herein.

Prefabricated concrete elements used in the construction of elevated and underground buildings are made in forms wherein the roughness coefficient of the surfaces of the forms which shape the surfaces of the concrete elements has an arithmetical mens deviation from the mean line of the profile of generally $R_a$=20–40 μm. Removal of the finished product from these forms requires at least partial disassembly of the formwork.

The extraordinary dimensional accuracy required for, e.g. tunnels, cannot be assured with the conventional forms which are partially disassembled to remove the finished element, unless very costly and complicated apparatus are used.

There is therefore a need for an apparatus which can be used to fabricate a series of concrete elements with a high degree of dimensional accuracy and reproducability as well as high productivity.

It is a primary object of this invention to provide an apparatus for producing concrete elements of high dimensional accuracy.

It is a further object of this invention to provide an apparatus which can be used to produce a series of dimensionally accurate concrete elements at a highly productive rate.

It is yet another object of this invention to provide an apparatus from which concrete elements produced therein can be removed without disassembling the apparatus while at the same time preserving the removed concrete element's structural and dimensional integrity, e.g. dimensions, corners and edges.

It is yet a further object of this invention to provide a rigid apparatus of undetachable or undismountable construction for the serial production of prefabricated concrete and reinforced concrete elements or formed products of a high dimensional accuracy that do not require cores, said apparatus having rigid form means for the products; means for filling the form means with the concrete and providing vibration to produce the formed products and means for removing the formed products from the form means without disassembling the form means.

SUMMARY OF THE INVENTION

This invention provides a rigid apparatus of undetachable or undismountable construction for the serial production of prefabricated concrete and reinforced concrete elements or formed products having dimensions which are accurate within close tolerance to desired predetermined specifications and which do not require cores. The apparatus enables the products to be formed with great efficiency and results in high productivity. The apparatus comprises, in combination, rigid form means for the products; means for filling said form means with concrete and providing vibration to produce the formed products; means for removing said formed products from said form means. The form means is an assembled, solid, coreless, rigid, high strength form having a lifting opening at its top with a base plate at its bottom for shaping at least bottom and side surfaces of the products. The lifting opening is a generally circular opening which has on the side surfaces thereof a temporarily fixed liner element which conforms to the shape of at least the two opposite inside surfaces of the lifting opening. The lifting opening is adapted to receive a removing means which has parts thereof which wedge therein. The form side surfaces of the form means that shape the product side surfaces have a surface roughness coefficient having arithmetical mean deviation from the mean line of the profile of at most $R_a$=1.25 μm. The side surfaces are substantially perpendicular to the base plate. The removing means includes means for at least partly lifting the formed products substantially vertically out of the top opening of the form means and also means for securing the form means when filled, in a rigid fixed position during product removal therefrom. There are also supporting means as part of the removing means for immobilizing the filled form and the product itself against tilting with respect to the filled form means.

The removing means includes a rollable frame having posts in a central part of the frame. The posts form part of the lifting means together with a frame operable by dual-acting work cylinders for moving the frame in a substantially vertical direction. The frame carries thereon a removing member for lifting the formed products out of the filling form in cooperation with the securing and immobilizing means.

In one embodiment, the filling means has at least one movable closure plate for limiting the top surfaces of the formed products during the filling of the concrete. The closure plate has at least one concrete filler opening.

The liner in the lifting opening is preferably made of sheet metal.

A suitable securing means is made of tie-down elements braceable against the filled form by the aid of dual acting work cylinders at the time the immobilizing means lifts out the formed product from the form in a direction substantially parallel with the preceding position of the product in the form. This assists in maintaining the integrity of the product dimensions and shape.

The dual acting work cylinders also operate supporting elements of the immobilizing means while the securing means holds down the filled form during product removal.

BRIEF DESCRIPTION OF THE DRAWINGS

The invention in a preferred exemplary embodiment is illustrated in the drawings in which;

FIG. 4*a* is the section as shown in FIG. 4 containing a screw and plate temporary fixing means;

FIG. 4*b* is the section as in FIG. 4*a* showing termination of the temporary fixing means by removal of the screw and plate;

FIG. 4*c* is the section as in FIG. 4 containing the lifting means in the lifting opening;

FIG. 4*d* is the section as in FIG. 4*c* showing the lifting means engaged in the liner in the lifting opening;

FIG. 4*e* is a sectional view of the product held free from the form by the lifting means;

FIG. 4*f* is a sectional view as in FIG. 4*e* showing the disengagement of the lifting means after the product is set down out of the form;

FIG. 4*g* is a sectional view of the product showing the liner as a part thereof;

FIG. 4*h* is a top plan view of the product in the form with the screw and plate temporary fixing means thereon;

FIG. 4*j* is a horizontal sectional view of the product showing the foundation contours of the liner;

FIG. 4*k* is a cross section elevational view of the empty form showing the liner;

DETAILED DESCRIPTION OF THE INVENTION

The objectives of this invention can be accomplished when the sides of the form which is preferably made of high strength material such as metal, are connected to each other rigidly. The sides of the form delimit its interior space. Because of their rigid connection, the sides do not move relative to each other. During use as intended, because of the shape of the sides, the form need not be disassembled. The roughness coefficient of the forming surfaces of the apparatus of this invention is chosen to have an arithmetical mean deviation from the mean line of the profile considerably smaller than $R_a$=20–40 μm, e.g. at most $R_a$=1.25 μm.

The concrete product is removed from the form by lifting it out while applying force to the form in the opposite direction and securing the product against tilting.

The apparatus has means for loading the product on a conveyance in addition to the forming means, the concreting means and form removal means.

The apparatus of the invention is an improvement over the prior art and permits the manufacture of the concrete products by an improved method.

Figure 1:
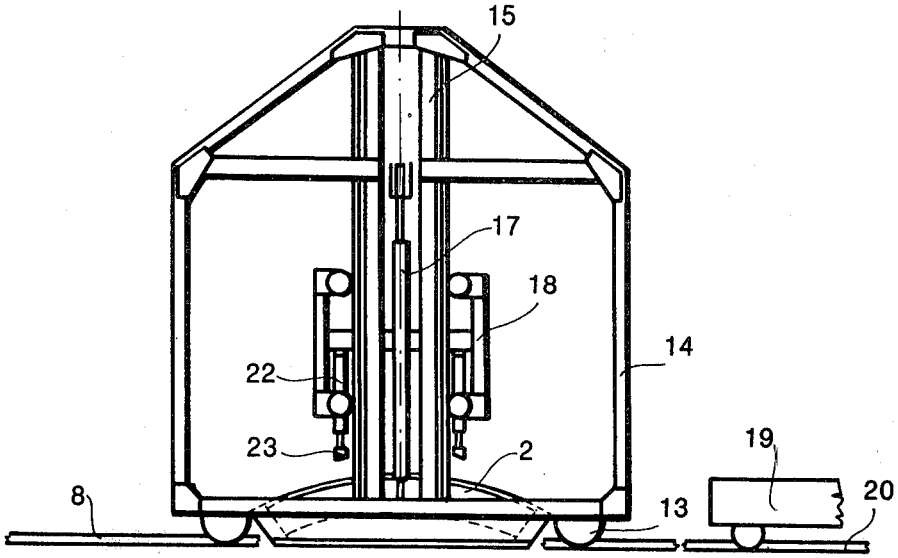
FIG. 1 is a side elevational view of the forming and form removing units of the apparatus of this invention.
Figure 2:
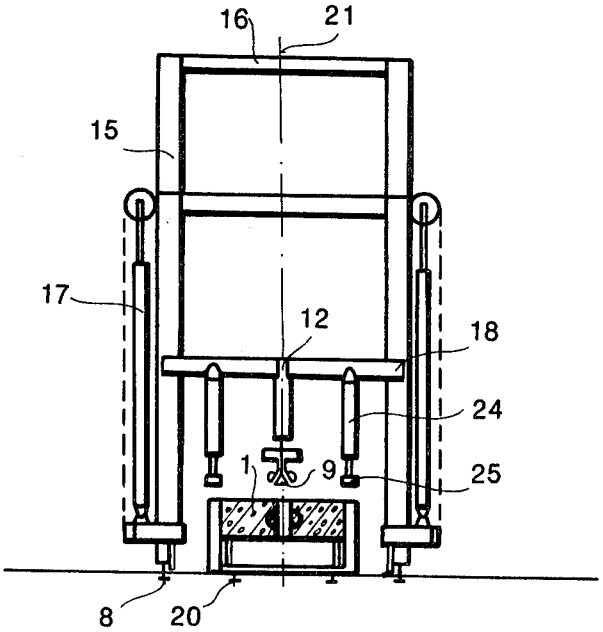
FIG. 2 is a front elevational view of the apparatus shown in FIG. 1.
Figure 3:
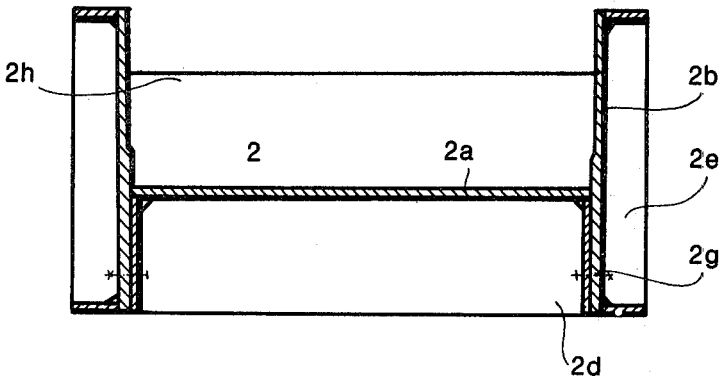
FIG. 3 is a form shown in cross-section.
Figure 4:
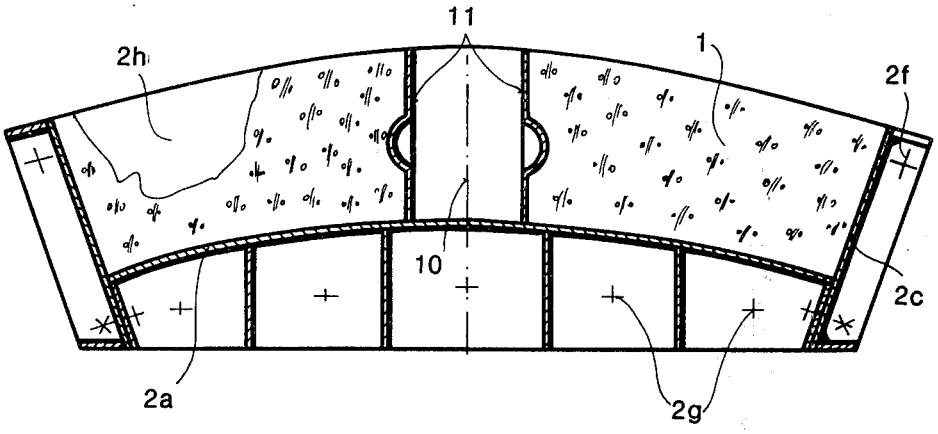
FIG. 4 is a longitudinal section of a concrete element or product in the form shown in FIG. 3.
Figure 5:
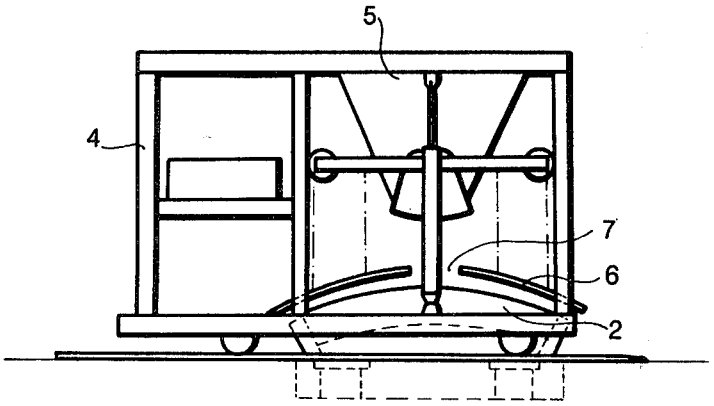
FIG. 5 is a side elevational view of a concreting unit.
Figure 6:
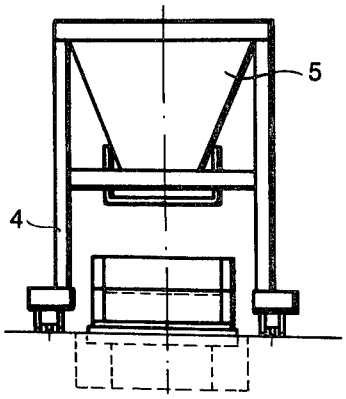
FIG. 6 is a front elevational view of the concreting unit of FIG. 5.
Figure 7:
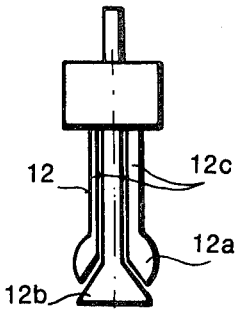
FIG. 7 is a side elevational view of a lifting means.

Turning now to the drawings, as can be seen from FIGS. 1–8, inclusive, the apparatus of the invention is comprised of three main units: the forming unit, depicted in FIGS. 1 and 2; the concreting unit, depicted in FIGS. 5 and 6; and the form removing unit, depicted in FIGS. 1 and 2.

A rigid high-strength form 2, shown in FIGS. 3, 4*h* and 4*k* has a bottom 2*a*, right- and left-hand sides 2*b* as well as upper and lower sides 2*c*. These delimit a forming space 2*h* for a product 1, see FIGS. 4, 4*a*, 4*b* and 4*c*, in this case from five sides. The form sides are rigidly attached so that the form does not undergo a change in shape during the charging of concrete, its working into the mold, and more importantly during the removal of the product 1 from the form 2. This is because, during the removal from the form 2 the supporting structures of the form removal unit subject the formwork to great stresses against pulling forces. To obtain the required rigidity, the bottom 2*a* and the sides 2*b*, 2*c* of the form preferably are made from steel.

The form bottom 2*a* is provided with stiffening ribs 2*d* and the sides 2*b* of the form 2 are provided with stiffening ribs 2*e*. The stiffening ribs 2*d* and 2*e* are respectively suitably welded to form the bottom 2*a* and the sides 2*b* of the form 2, respectively. The bottom 2*a* and the sides 2*b* are rigidly fixed by fitted screws 2*g* and 2*f*, respectively (shown schematically).

The geometric shape and the surface treatment of the sides 2*b* and 2*c* of the form 2 is such that form removal is promoted. Furthermore, the form 2 may be provided with nests which make possible the temporary fixing of locating rods for determining the relative positions of adjoining concrete elements. An example of a temporary fixing means is shown in FIG. 4*a* wherein a plate 11*d* is held by a screw 11*c* over the lifting opening 10 to temporarily firmly fix the lining element 11 in the form 2.

The lining element (liner) 11 is a generally circular element held in place in the lifting opening 10 of the form 2, before the concrete is poured, by a temporary fixing means such as shown in FIGS. 4*a* and 4*b*. The depicted temporary fixing means comprises a plate 11*d* held in place by a screw 11*c*. There are depressions 11*b* in the liner walls which ultimately receive the lifting means 12 as shown in FIGS. 4, 4*c*, 4*d*, 4*e* and 4*f*.

The liner 11 is made of metal and is disposed along the walls of the lifting opening 10. It is adaptable to the shape of the walls of the lifting opening 10. When concreting the product 1 the lining element 11 fills the role of the form which determines the shape of the lifting opening 10.

The liner 11 is not firmly connected to the sidewalls of the form 2. That is the reason it needs to be temporarily fixed thereto by a temporary fixing means.

After the concrete is poured, vibrated and solidified, the product 1 is removed by the lifting means 12 as shown in FIG. 4*d*. The liner 11 lifts out with the product 1 and becomes a part thereof.

As can be seen in FIG. 4*j*, the shape of the liner 11 is generally circular with oppositely disposed depressions 11*b*. The outside dimensions of the liner 11 are such that it is wholly within the form 2 and does not cause the product 1 to be removed as two pieces. The lifting opening 10 can be completely through the product wall as depicted in the drawings, but preferably it is only part way through.

The concreting unit (FIGS. 5 and 6) has a concreting cart 4 which can move along a predetermined course 3, and a concrete container 5 from which concrete reaches through at least one filler opening 7 into the forming space 2*h* therebelow (FIG. 5). Closing plates 6 will be described later.

Figure 8:
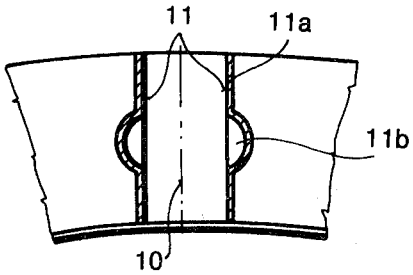
FIG. 8 is a side section elevational view of a lifting opening with a liner, as used in the product shown in FIG. 4.

As can be seen in FIGS. 4 and 8, the lifting opening 10 is formed in the center of the gravity of the product 1, and the interior wall of the opening is covered with at least one liner element 11 as described above, e.g. a metal lining the inner surface of the lifting opening 10. Its role is to enable the lifting out of the finished product 1 from the form 2 at the time of removal by means of lifting or removing member 12 (see FIGS. 2, 4*c*, 4*d*, 4*e*, 4*f* and 7) placed from above and fixed in the lifting opening 10.

The main parts of the lifting element 12 are the tool halves 12*c* having extensions 12*a* between which is a spreading wedge 12*b* to spread apart the tool halves 12*c* and cause the extensions 12*a* to fit into the depressions 11*b* in the liner 11.

In this case, the lifting member is preferably a tool provided with tool halves 12*c* having extensions 12*a* between which a spreading wedge 12*b* can be inserted. In FIG. 2, the tool portions are schematically identified by numeral 9, also used for this purpose in FIG. 7. The tool halves 12*c* are pushed apart by an upward acting force brought about by the spreading wedge 12*b* as shown in FIGS. 4*d* and 4*e*, whereupon the extension 12*a* spreads against depressions 11*b* of a liner plate 11*a* of the liner element 11.

The form removal unit (FIGS. 1 and 2) has a self-driven frame 14 provided with wheels 13, which is adapted to move along a path 8. The frame 14 has posts 15, and a top connecting beam 16. A lifting frame 18 is vertically movable on the posts 15. The lifting frame 18 operates the dual-acting work cylinders 17, which are connected to and moved by a conventional hydraulic mechanism. A path 20 of a transporting carriage 19 (FIG. 1) for moving the product 1 is disposed within the path 8 of the frame 14.

The lifting member 12 is connected with the lifting frame 18 which is disposed in the theoretical centerline 21 of the path 20 (FIG. 2). Supporting elements 23 are also arranged in the theoretical centerline 21 of the path 20, which are connected to, and driven by, dual-function cylinders 22, such as hydraulic work cylinders. The supporting elements 23 prevent the tilting of the lifting frame 18.

In FIG. 2, the tie-down elements 25 are shown to be connected to, and driven by, dual-function hydraulic cylinders 24; the elements 25 fix the form 2 in place during removal of the product 1, as well as bring about relative movement between the form 2 and the product 1.

The production of concrete elements of high dimensional accuracy is carried out according to the invention as follows: An empty form 2 is placed onto a cleaning area with the aid of a lifting means, such as a bridge crane (not shown) and then carefully cleaned of materials left in it from previous fabrication and, if needed, the element or product forming surfaces of the form 2 are treated with a fine grain sandpaper. Subsequently, the surfaces enclosing the forming space 2*h*, i.e. the sides 2*b* and 2*c* and the forming surfaces 2*a* of the base of the form 2, are smeared with an agent that aids in stripping the form 2 from the product 1, e.g. grease.

If the prefabricated element contains reinforcing inserts, then they are placed into the forming space 2*h* and are temporarily fixed in place therein. At the same time the lining element 11, which assures the lifting out of the product, is placed and then also temporarily fixed in place. Then the form 2 is transported by the bridge crane to the concreting unit where concrete is filled and worked into the form 2 while the form 2 is vibrated. Since the form 2 delimits five sides of the product 1 and, for example, has an arched top surface as shown if FIGS. 4, 4*a*, 4*b*, 4*c*, 4*d*, 4*e*, 4*f* and 4*g*, care has to be taken during the filling and working of the concrete in the form 2 that the sixth, i.e. the top side, does not lose any concrete from the form 2. This is done by the vertically movable closing plates 6 which are part of the concreting unit as shown in FIG. 5. Thus the closure plate or plates 6 is (are) lowered onto the form 2 and temporarily attached to it before filling the concrete into the form 2.

After working the concrete into the form 2, the form 2 is placed, together with the product 1 in it, into a setting vat (not shown), where the setting of the concrete is accelerated by known means, e.g. by heat transfer.

After the setting is completed, the form 2 which contains the product 1, is placed with the bridge crane onto the path 20 which is in the theoretical centerline 21 of the path 8. Then the form removal unit is rolled along the path 8 and placed above the product as shown in FIG. 2. The lifting element 12 is connected to the lifting frame 18, which latter is driven upward by the cylinders 17. Then the supporting elements 23 which are actuated by the cylinders 22 (see FIG. 1) are braced against the top surface of the product 1. The form 2 is fixed in relation to the form removal unit by the tie-down elements 25 that are actuated by the cylinders 24, and then relative movement is created between the product 1 and the form 2.

The operation of the lifting element 12 is shown in FIGS. 4*c*, 4*d*, 4*e* and 4*f* wherein it drops in a closed position between the side plates 11*a* of the element 11, that is, without the wedge 12*b* pushing the extensions 12*a* apart. Then the wedge 12*b* is forced upward between the extensions 12*a*, pushing them apart so they engage the depressions 11*b* in the walls 11*a* of the liner 11 (FIGS. 4*c*, 4*d* and 4*e*). The product 1 is then vertically lifted from the form 2. After the product 1 is lifted, the hydraulic work cylinders 17 lift the frame 18 together with the product 1. Naturally, during the lifting, the supporting elements 23 do not change their relative positions. After the product 1 leaves the form 2, the supporting and lifting actions of the hydraulic work cylinders 22 and 24, respectively, ceases and at this point the product 1 merely hangs by the lifting element 12. The product 1 in this position is placed onto the transport carriage 19 by means of the self-driven frame 14. This action releases the lifting element 12 which is then removed. The form is then carried by the bridge crane to the cleaning position. The above described procedure can be cyclically repeated in the same manner.

We claim:

1. A rigid apparatus of undemountable construction for the serial production of prefabricated concrete and reinforced concrete elements or formed products of a high dimensional accuracy that do not require solid inner cores, the apparatus comprising, in combination: rigid form means for the products; means for filling said form means with concrete and providing vibration to produce the formed products; and means for removing the said formed products from said form means; wherein, said form means is an assembled, solid, coreless, rigid, high-strength form having an opening at its top, with a base plate at its bottom, for shaping at least bottom and side surfaces of the products, wherein at least one oriented and temporarily fixed circular liner element is on and conforms to the shape of at least two opposite side surfaces of said opening in said form means, and which has depressions to receive a lifting means which has spreading extension elements and a wedge means which, when pulled upward spreads the extension elements apart so they fit into the liner depressions, wherein the form side surfaces of said form means that shape the product side surfaces have a surface roughness coefficient having an arithmetical mean deviation from the mean line of the profile of at most, $R_a = 1.25\ \mu m$ and are substantially parallel to the pulling force of said lifting means and substantially perpendicular to the base plate, which lifting means includes means for at least partly lifting the formed product substantially vertically out of the top opening of said filled form means; and further comprise means for securing said filled form in a rigid, fixed position during product removal therefrom, constituted by tie-down elements braceable against said filled form by the aid of dual-acting work cylinders, while immobilizing means which includes supporting elements operable by dual-acting work cylinders which force said securing means against said filled form immobilizing said filled form and the product itself against tilting with respect to said filled form means while lifting out the formed products from said filled form in a substantially vertical direction substantially parallel with the preceding position of said products within said form; wherein said lifting means includes a rollable frame having posts in a central part of said frame, said posts forming part of said lifting means together with a lifting frame operable by said dual-acting work cylinders for substantially vertically moving said frame, the latter carrying thereon a removing member for lifting the formed products out of said filling form, in cooperation with said securing and immobilizing means.

2. The apparatus as defined in claim 1, wherein said filling means has at least one movable closure plate for limiting the top surfaces of the formed products during the filling of the concrete, in which plate there is formed at least one concrete filler opening.

3. The apparatus as defined in claim 1, further comprising said oriented liner for said form being made of sheet metal.

* * * * *